US006059288A

United States Patent [19]

Popadiuk et al.

[11] Patent Number: 6,059,288

[45] Date of Patent: May 9, 2000

[54] RETRACTABLE BALL CAGE FOR A ROLLING BALL GAME

[75] Inventors: John A. Popadiuk, Schaumburg; John W. Skalon, Des Plaines; Ernest Pizzarro, Chicago, all of Ill.

[73] Assignee: Williams Electronics Games, Inc., Chicago, Ill.

[21] Appl. No.: 08/692,744

[22] Filed: Aug. 6, 1996

[51] Int. Cl.[7] ..... A63F 7/30

[52] U.S. Cl. ..... 273/118 A; 273/127 R; 273/121 A

[58] Field of Search ..... 273/118 R, 118 D, 273/118 A, 119 R, 119 A, 121 R, 121 A, 127 R, 127 B, 126 R, 126 A, 108, 123 R, 123 A

[56] References Cited

U.S. PATENT DOCUMENTS

| | | | |
|---|---|---|---|
| 2,565,238 | 8/1951 | Koci | 273/126 A |
| 2,990,180 | 6/1961 | Koci | 273/126 A |
| 3,578,802 | 5/1971 | Murphy et al. | 273/121 A |
| 3,817,519 | 6/1974 | Leonhart | 273/126 A X |
| 4,215,863 | 8/1980 | Kuiper | 273/126 R |
| 4,426,081 | 1/1984 | Fainzilberg | 273/118 D X |
| 4,429,876 | 2/1984 | Halliburton et al. | 273/121 A |
| 4,804,186 | 2/1989 | Moravec | 273/121 A X |
| 4,968,031 | 11/1990 | Kaminkow et al. | 273/121 A |
| 5,415,403 | 5/1995 | Ritchie et al. | 273/121 A |

*Primary Examiner*—Raleigh W. Chlu
*Attorney, Agent, or Firm*—Rudnick & Wolfe

[57] ABSTRACT

A ball locking device includes a plurality of posts arranged to retract into or extendabove apertures in the game playfield. In the extended position, the posts form a cage which confines a game ball therein. The posts are arranged, for example, in a circular pattern and spaced from one another at a distance less than the diameter of the game ball. A solenoid, in conjunction with sensing devices, controls the movement of the posts to capture the ball in play or to release the captured ball at an appropriate time during game play. The locking device is hidden from the players view when in its retracted position.

13 Claims, 3 Drawing Sheets

RETRACTABLE BALL CAGE FOR A ROLLING BALL GAME

BACKGROUND

The invention relates generally to pinball or rolling ball games. Specifically, the invention relates to a device for capturing a rolling ball on a game playfield.

Pinball games comprise a game cabinet having an inclined playfield mounted therein for supporting one or more game balls. Various play features are mounted on the playfield for engagement with the game ball, which is controlled by the player using pivoting flippers that contact and project it. Ball locks are devices which capture and store a ball on the game playfield for later use in the game. A locked ball may be released when a player, while playing another ball on the playfield, accomplishes a predetermined sequence of game objectives to release the stored ball. Ball locks thus function to provide multiple ball play in which two or more balls may be played simultaneously on the playfield for increased game action and scoring.

Pinball games derive their appeal from the novel construction and arrangement of the play features which make the game exciting and challenging. Furthermore, since game challenge decreases as players become more skilled at the game, it is necessary to provide new game features and arrangements in order to maintain player interests and satisfy the needs of the pinball market.

SUMMARY OF THE INVENTION

The present invention provides a novel and unique ball lock in the form of a retractable cage housed on the game playfield. The cage comprises a series of posts which are mounted beneath the playfield and raised through holes in the playfield at appropriate times during game play. The posts are preferably hidden from the player's view when not extending above the playfield. The posts are arranged, for example, in a circular pattern and spaced from one another at a distance less than the diameter of the game ball. A solenoid element deploys the posts from a position below the game playfield to a position above the game playfield at an appropriate time to capture the ball in play. Sensor elements are positioned on the playfield to capture the ball as it rolls past a predetermined position.

DETAILED DESCRIPTION

Figure 1:
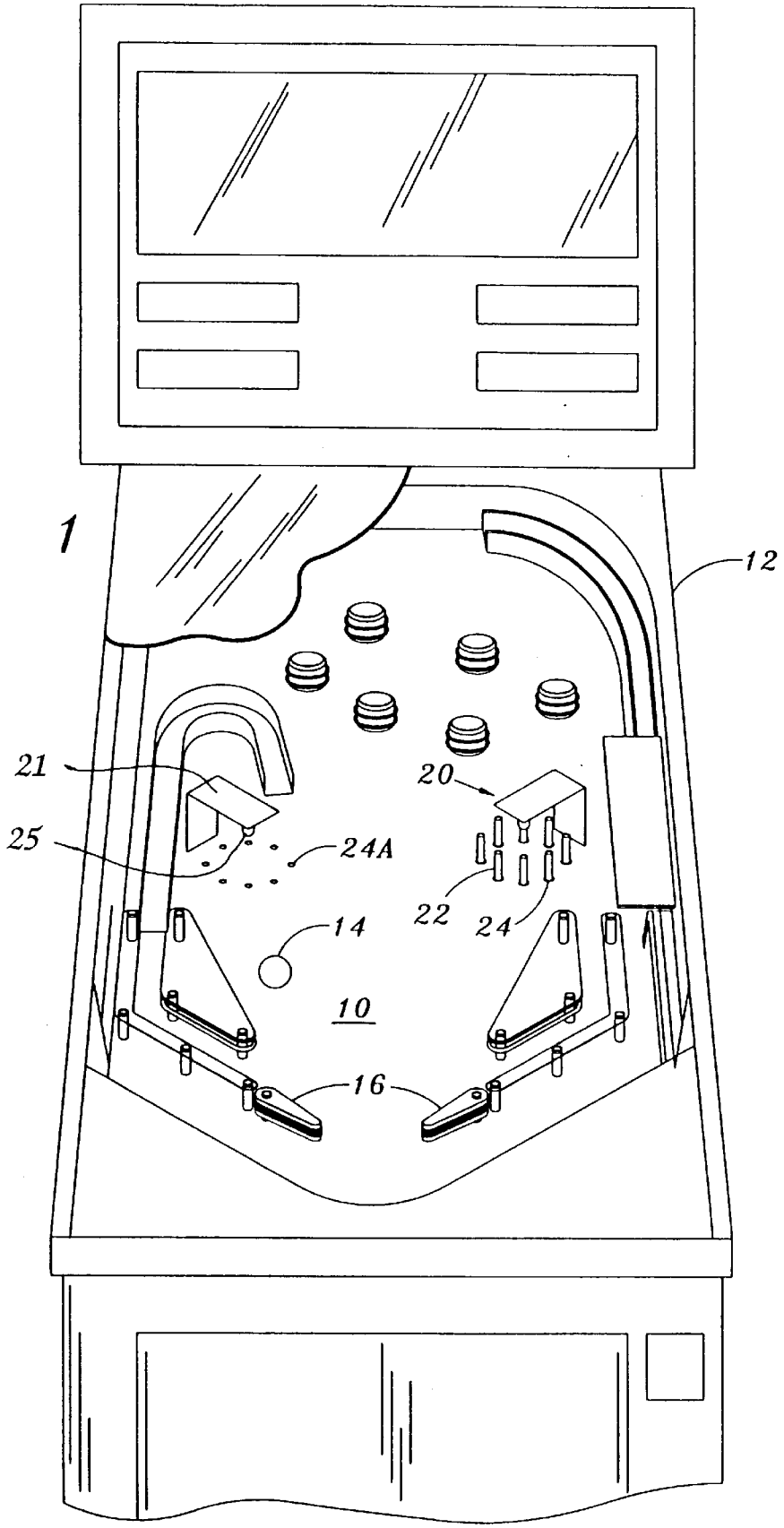
FIG. 1 is a plan view of a pinball game incorporating a preferred embodiment of the present invention.

Referring to FIG. 1, a preferred embodiment of the present invention comprises an inclined playfield 10 housed within a game cabinet 12 and supporting a rolling ball 14 thereon. Flipper elements 16 permit the player to control the movement of the game ball. This structure is well known in the art. In accordance with the present invention, playfield 10 is provided with at least one ball locking cage 20, comprising a plurality of posts 22 which extend through apertures 24 in the playfield 10. Cage 20 is shown in its extended position. A second ball locking cage (shown retracted into playfield 10) is provided at a position corresponding to apertures 24A. A sensor bracket 21 extends above playfield 10 and is provided with an LED 25, which cooperates with an optical detector 27 (not shown) to detect the presence of game ball 14 when it travels to a position at which it may be captured.

Figure 2:
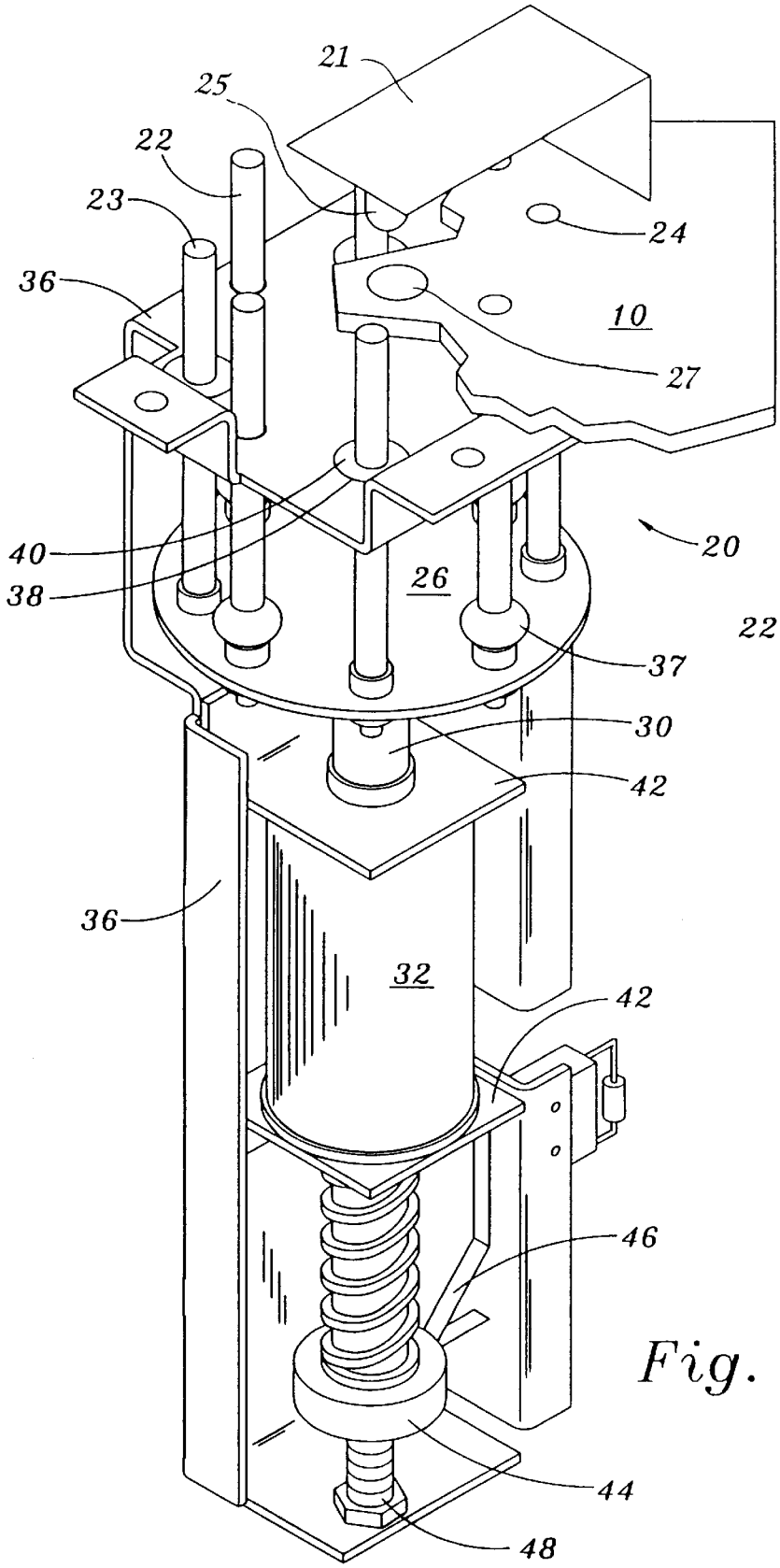
FIG. 2 is an isometric view of a ball locking cage according to a preferred embodiment of the invention.

Referring to FIG. 2, ball locking cage 20, shown in its retracted position within playfield 10, comprises posts 22 which are arranged in a circular pattern and secured to a flange 26 by threaded fasteners (not shown) or other conventional means. Posts 22 define a circular ball-confining space. Flange 26 is secured to the armature or plunger 30 of solenoid 32. Solenoid 32 is secured to the underside of playfield 10 via bracket 36. Bracket 36 is also provided with apertures 38, through which posts 22 extend. Apertures 38 are preferably provided with nylon guide members 40 to reduce friction and wear of posts 22 as they repeatedly reciprocate with respect to playfield 10 and bracket 36. Preferably, bumper rings 37 are provided around the base of some or all of posts 22 to protect bracket 36 and the base of posts 22 against damage from impact when the posts are deployed upward. A pair of L-shaped flanges 42 secure the solenoid 32 to bracket 36.

The armature 30 of solenoid 32 is provided with an extension collar 44 at an end opposite locking cage 20. Extension collar 44 functions to actuate limit switch 46 to signal the game control system when the cage is fully retracted. An adjustable stop 48 is provided on bracket 36 in the form of a nylon tip threadably fastened to bracket 36. The purpose of stop 48 is to adjust the retracted position of the solenoid armature 30, and thus the position of posts 22 with respect to the playfield surface. It is preferable to have the distal ends 23 of posts 22 flush with the playfield surface 1 0 when the cage 20 is in its retracted position such that the game ball may roll smoothly over the apertures 24.

Figure 3:
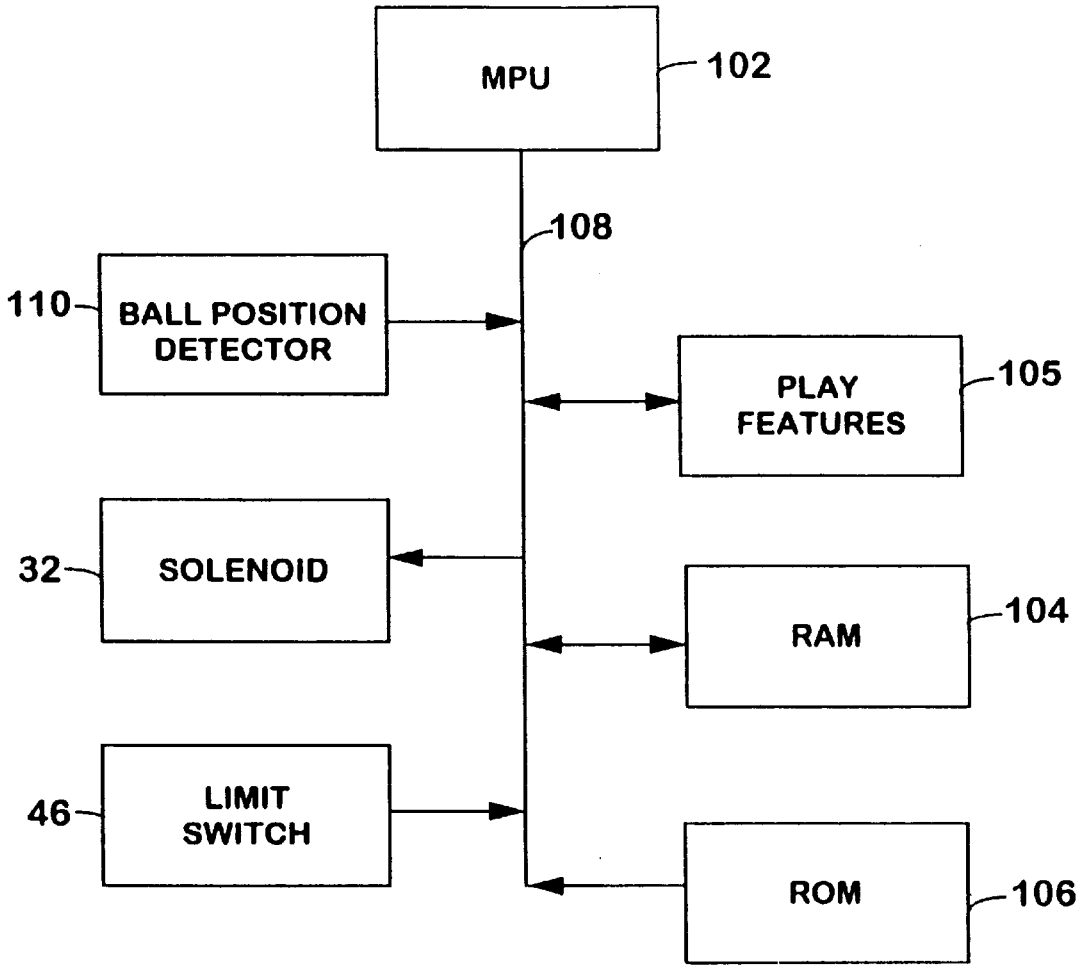
FIG. 3 is a block diagram of a control system for a ball locking cage according to a preferred embodiment of the present invention.

An upright sensor bracket 23 extends above playfield 10. LED 25 is mounted to the distal end of bracket 23 and cooperates with optical detector 39 which is disposed on the playfield 10 at the center of the circle formed by posts 22. LED 25 projects a generally vertical light beam towards optical detector 27 and serves as the ball position detector 110 (FIG. 3). Ball position detector 110 provides a signal to a game microprocessor in a manner described below, to actuate the ball locking cage when the game ball passes into the area surrounded by posts 22.

Referring to FIG. 3, a typical game computer system able to control the locking cage in accordance with the invention comprises microprocessor unit (MPU) 102 which executes game program instructions stored in ROM 106 via bus 108. Detector 110 is connected to bus 108. Microprocessor 102, in executing the game program, periodically checks the status of detector 110 to determine whether the game ball is within the capture area on the playfield. Microprocessor 102 also determines the status of other game features, represented generally at 105, such as targets or bumpers, which may include game objectives that must be accomplished before the locking cage is deployed. After the required objectives are achieved by the player and a game ball enters the capture area, microprocessor 102 energizes the corresponding solenoid 32. The locking cage is then projected upwards through the playfield to capture the rolling ball. Solenoid 32 remains energized and cage 20 deployed until predetermined game objectives are accomplished. This may include the introduction of an additional ball onto the playfield. After further game objectives are achieved, solenoid 32 is de-energized, cage 20 retracted, and the locked ball is released. Release may occur while another ball is in play to effect multiple ball play. Alternatively, cage 20 may be positioned on the playfield 10 near a ball drain chute such that deployment of the cage will save the ball from being drained.

Those of ordinary skill will understand that the foregoing embodiments are intended to exemplify the invention and are not intended to limit its scope which is defined in the appended claims.

What is claimed is:

1. A retractable ball locking device for a rolling ball game having an inclined playfield for supporting a rolling ball thereon, the ball locking device comprising:

a) a plurality of elongate posts arranged to define a ball confining cage, the posts adapted to be disposed in apertures in said playfield; and b) means for simultaneously moving the posts from a first position in which the posts are disposed at or below the level of the playfield to a second position in which the posts project above the playfield;

whereby timely movement of the posts captures the rolling ball.

2. The device of claim 1, further comprising means for sensing when the game ball is within the area of the ball confining cage.

3. The device of claim 2, wherein the means for sensing comprises an optical detector.

4. The device of claim 1, wherein said means for moving the posts include a solenoid disposed beneath the playfield to which said posts are secured for movement therewith.

5. The invention of claim 4, further comprising an adjustable stop associated with said solenoid for adjusting the first position of the posts such that distal ends of the posts are flush with the playfield.

6. The device of claim 4, further comprising means for sensing when the game ball is within the area of the ball confining cage.

7. The device of claim 6, wherein said solenoid is extended responsive to said sensing means.

8. The invention of claim 1, further comprising low friction guide members disposed in the apertures for reducing friction between the posts and apertures as the posts move.

9. In combination: a rolling ball game having an inclined playfield for supporting a rolling ball thereon and a ball locking device, said device comprising:

a) a plurality of elongate posts arranged to define a ball confining cage, the posts adapted to be disposed in apertures in said playfield; and b) a solenoid for simultaneously moving the posts from a first position in which the posts are disposed at or below the level of the playfield to a second position in which the posts project above the playfield;

whereby timely movement of the posts captures the rolling ball.

10. The combination of claim 9, further comprising an optical detector for sensing when the game ball is within the area of the ball confining cage.

11. The combination of claim 10, wherein said solenoid is extended responsive to said optical detector.

12. The combination of claim 11, further comprising an adjustable stop associated with said solenoid for adjusting the first position of the posts such that distal ends of the posts are flush with the playfield.

13. The combination of claim 12, further comprising low friction guide members disposed in the apertures for reducing friction between the posts and apertures as the posts move.

* * * * *